US009080268B2

(12) United States Patent
Yamada

(10) Patent No.: US 9,080,268 B2
(45) Date of Patent: Jul. 14, 2015

(54) DEVICE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventor: Kenji Yamada, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/514,907

(22) Filed: Oct. 15, 2014

(65) Prior Publication Data

US 2015/0120034 A1 Apr. 30, 2015

(30) Foreign Application Priority Data

Oct. 31, 2013 (JP) ..... 2013-226119

(51) Int. Cl.
*D05C 5/02* (2006.01)
*D05B 19/08* (2006.01)

(52) U.S. Cl.
CPC . *D05B 19/08* (2013.01); *D05C 5/02* (2013.01)

(58) Field of Classification Search
CPC ..... D05B 19/02; D05B 19/04; D05B 19/08; D05B 19/10; D05B 19/12; D05C 5/00; D05C 5/02
USPC ..... 700/136–138
See application file for complete search history.

(56) References Cited

U.S. PATENT DOCUMENTS

| | | | | |
|---|---|---|---|---|
| 5,576,968 | A * | 11/1996 | Mizuno et al. | 700/138 |
| 5,791,271 | A * | 8/1998 | Futamura | 700/138 |
| 6,324,441 | B1 | 11/2001 | Yamada | |
| 6,356,648 | B1 * | 3/2002 | Taguchi | 700/138 |
| 6,952,626 | B1 | 10/2005 | Taguchi et al. | |
| 8,200,357 | B2 * | 6/2012 | Yamada | 700/138 |
| 2002/0038162 | A1 | 3/2002 | Yamada | |
| 2005/0182508 | A1 * | 8/2005 | Niimi et al. | 700/138 |
| 2005/0222704 | A1 | 10/2005 | Taguchi et al. | |
| 2007/0162177 | A1 * | 7/2007 | Yamada | 700/138 |
| 2007/0233309 | A1 * | 10/2007 | Yamada | 700/138 |
| 2008/0289553 | A1 * | 11/2008 | Yamada | 112/470.04 |
| 2009/0138120 | A1 * | 5/2009 | Yamada | 700/138 |
| 2009/0299518 | A1 * | 12/2009 | Yamada | 700/138 |
| 2010/0145494 | A1 * | 6/2010 | Yamada | 700/138 |

(Continued)

FOREIGN PATENT DOCUMENTS

| | | |
|---|---|---|
| JP | A-2000-288275 | 10/2000 |
| JP | A-2001-259268 | 9/2001 |

(Continued)

*Primary Examiner* — Nathan Durham
(74) *Attorney, Agent, or Firm* — Oliff PLC

(57) ABSTRACT

A device includes a processor and a memory configured to store computer-readable instructions that, when executed by the processor, cause the device to perform processes that include acquiring image data, extracting one or more first pixels, arranging one or more first line segments in one or more first positions, determining one or more first colors, connecting the one or more first line segments, arranging one or more second line segments in one or more second positions such that none of the one or more second line segments overlaps with any one of the one or more first positions, determining one or more second colors, connecting the one or more second line segments, and creating embroidery data based on the connected one or more first line segments and on the connected one or more second line segments.

10 Claims, 7 Drawing Sheets

(56) References Cited

U.S. PATENT DOCUMENTS

| | | | | |
|---|---|---|---|---|
| 2010/0305744 | A1* | 12/2010 | Yamada | 700/138 |
| 2011/0160894 | A1* | 6/2011 | Yamada | 700/138 |

FOREIGN PATENT DOCUMENTS

| | | |
|---|---|---|
| JP | A-2002-263386 | 9/2002 |
| JP | A-2005-278985 | 10/2005 |

* cited by examiner

DEVICE AND NON-TRANSITORY COMPUTER-READABLE MEDIUM

CROSS-REFERENCE TO RELATED APPLICATION

This application claims priority to Japanese Patent Application No. 2013-226119, filed on Oct. 31, 2013, the content of which is hereby incorporated herein by reference in its entirety.

BACKGROUND

The present disclosure relates to a device that is capable of creating embroidery data to enable a sewing machine to sew an embroidery pattern, and also to and a non-transitory computer-readable medium.

An embroidery data creation device is known that is configured to create embroidery data that enables a sewing machine capable of embroidery sewing to sew an embroidery pattern of a design that is based on image data of an image, such as a photograph or the like. For example, with the embroidery data creation device, line segments corresponding to stitches may be arranged based on image data that is acquired from an image read by an image scanner unit. After that, colors corresponding to the respective line segments may be determined, and the line segments that have the same color may be connected. The embroidery data may be created by converting data for the line segments into data indicating stitches.

SUMMARY

When embroidery stitches are used to express an image such as a photograph or the like, more detailed expression is possible by shortening lengths of the stitches. However, the lengths of the stitches that can be sewn depend on the thickness of an embroidery thread or a diameter of a needle. For that reason, there is a limitation on shortening the lengths of the stitches. As it is necessary for the length of a stitch to be several times the thickness of the embroidery thread, a point cannot be expressed by a stitch as can be expressed by one of pixels that make up the image. Therefore, even when embroidery sewing is performed based on the embroidery data created by the above-described embroidery data creation device, a tiny portion of an image, such as a photograph or the like, may not always be expressed by embroidery.

Various embodiments of the broad principles derived herein provide a device and a non-transitory computer-readable medium that each enables creating of embroidery data that is capable of expressing a tiny portion of an image such as a photograph or the like.

Various embodiments herein provide a device that includes a processor and a memory configured to store computer-readable instructions. The computer-readable instructions, when executed by the processor, cause the device to perform processes. The processes include acquiring image data. The image data includes data for a physical quantity indicating respective colors of a plurality of pixels. The processes also include extracting, based on the image data, one or more first pixels from among the plurality of pixels. Each of the one or more first pixels is a pixel for which a physical quantity indicating a color of the pixel is different, by at least a specified amount, from a physical quantity indicating a color of an adjacent pixel. The processes further include arranging one or more first line segments in one or more first positions respectively corresponding to the one or more first pixels. The processes further include determining one or more first colors respectively corresponding to the one or more first line segments, based on one or more respective colors of the one or more first pixels. The processes further include connecting the one or more first line segments for each of the one or more first colors. The processes further include arranging one or more second line segments in one or more second positions respectively corresponding to one or more second pixels such that none of the one or more second line segments overlaps with any one of the one or more first positions. The one or more second pixels are one or more pixels, among the plurality of pixels, other than the one or more first pixels. The processes further include determining one or more second colors respectively corresponding to the one or more second line segments, based at least on one or more respective colors of the one or more second pixels. The processes further include connecting the one or more second line segments for each of the one or more second colors. The processes further include creating embroidery data based on the one or more first line segments connected for each of the one or more first colors and on the one or more second line segments connected for each of the one or more second colors. The embroidery data indicates one or more first stitches and one or more second stitches. The embroidery data also indicates that the one or more first stitches are sewn before the one or more second stitches. The one or more first stitches respectively correspond to the one or more first line segments. The one or more second stitches respectively correspond to the one or more second line segments.

Various embodiments also provide a non-transitory computer-readable medium storing computer-readable instructions. The computer-readable instructions, when executed by the processor, cause the device to perform processes. The processes include acquiring image data. The image data includes data for a physical quantity indicating respective colors of a plurality of pixels. The processes also include extracting, based on the image data, one or more first pixels from among the plurality of pixels. Each of the one or more first pixels is a pixel for which a physical quantity indicating a color of the pixel is different, by at least a specified amount, from a physical quantity indicating a color of an adjacent pixel. The processes further include arranging one or more first line segments in one or more first positions respectively corresponding to the one or more first pixels. The processes further include determining one or more first colors respectively corresponding to the one or more first line segments, based on one or more respective colors of the one or more first pixels. The processes further include connecting the one or more first line segments for each of the one or more first colors. The processes further include arranging one or more second line segments in one or more second positions respectively corresponding to one or more second pixels such that none of the one or more second line segments overlaps with any one of the one or more first positions. The one or more second pixels are one or more pixels, among the plurality of pixels, other than the one or more first pixels. The processes further include determining one or more second colors respectively corresponding to the one or more second line segments, based at least on one or more respective colors of the one or more second pixels. The processes further include connecting the one or more second line segments for each of the one or more second colors. The processes further include creating embroidery data based on the one or more first line segments connected for each of the one or more first colors and on the one or more second line segments connected for each of the one or more second colors. The embroidery data indicates one or more first stitches and one or more second stitches. The embroidery data also indicates that the one or more first stitches are sewn before the one or more second stitches. The one or more first stitches respectively correspond to the one or more first line segments. The one or more second stitches respectively correspond to the one or more second line segments.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. First, a configuration of an embroidery data creation device 1 will be explained with reference to FIG. 1. The embroidery data creation device 1 is a device that is configured to create embroidery data that enables a sewing machine 3 (refer to FIG. 2), which will be described later, to form stitches of an embroidery pattern. The embroidery data creation device 1 of the present embodiment is capable of creating embroidery data for performing embroidery sewing of a design that is based on an image such as a photograph or the like.

Figure 1:
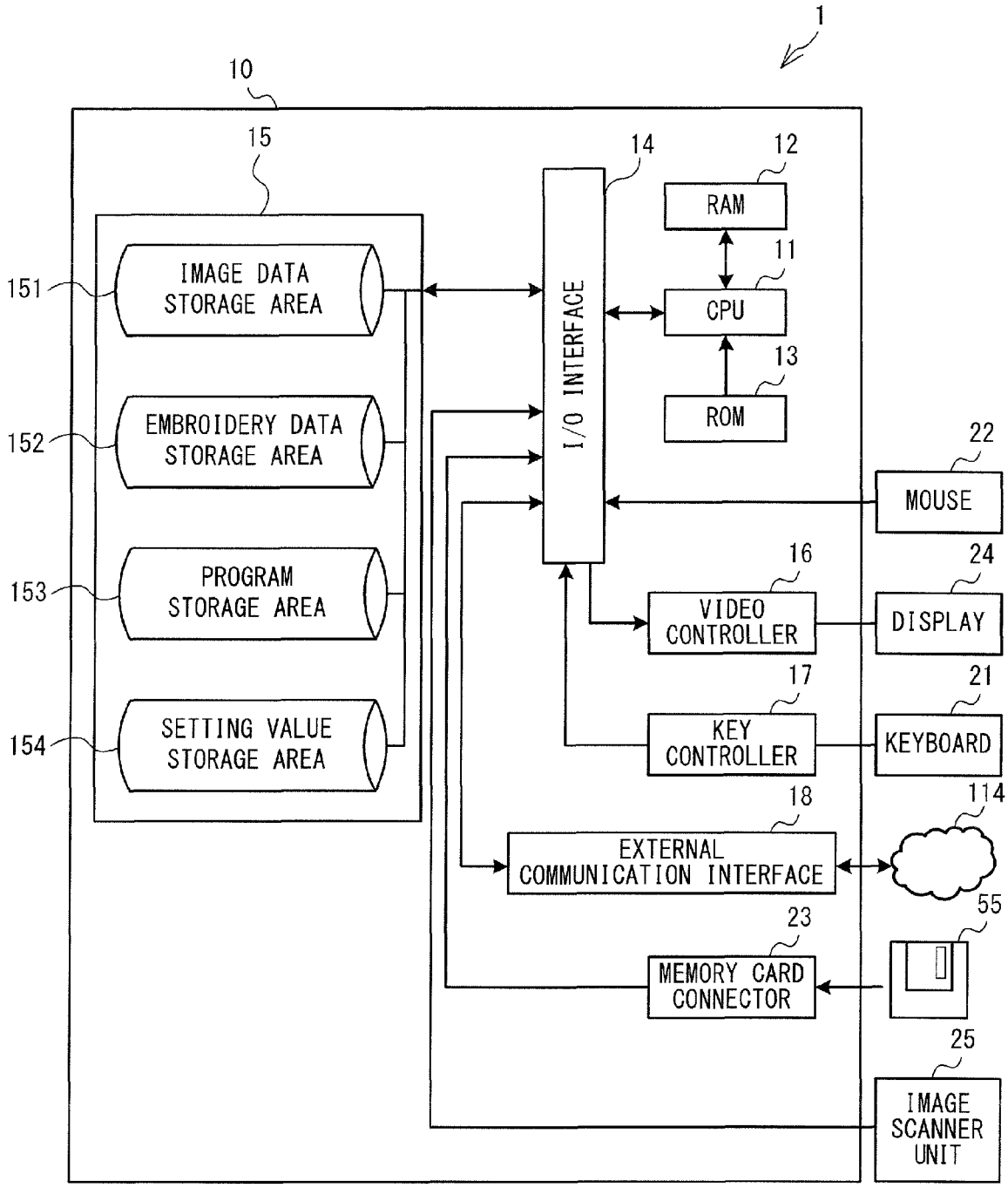
FIG. 1 is a block diagram showing an electrical configuration of an embroidery data creation device.

The embroidery data creation device 1 may be a dedicated device that is only configured to create the embroidery data. The embroidery data creation device 1 may also be a general-purpose device such as a personal computer or the like. In the present embodiment, a general-purpose form of the embroidery data creation device 1 is explained as an example. As shown in FIG. 1, the embroidery data creation device 1 includes a CPU 11, which is a controller that is configured to perform control of the embroidery data creation device 1. A RAM 12, a ROM 13, and an input/output (I/O) interface 14 are connected to the CPU 11. The RAM 12 is configured to temporarily store various types of data, such as calculation results that are obtained in calculation processing by the CPU 11, and the like. The ROM 13 is configured to store a BIOS and the like.

The I/O interface 14 is configured to perform mediation of data transfers. A hard disk device (HDD) 15, a mouse 22, which is an input device, a video controller 16, a key controller 17, an external communication interface 18, a memory card connector 23, and an image scanner unit 25 are connected to the I/O interface 14.

A display 24, which is a display device, is connected to the video controller 16. A keyboard 21, which is an input device, is connected to the key controller 17. The external communication interface 18 is an interface that is configured to enable connection to a network 114. The embroidery data creation device 1 is capable of connecting to an external device through the network 114. A memory card 55 can be connected to the memory card connector 23. The embroidery data creation device 1 is configured to read data from the memory card 55 and write data to the memory card 55 through the memory card connector 23.

Storage areas in the HDD 15 will be explained. As shown in FIG. 1, the HDD 15 has a plurality of storage areas that include an image data storage area 151, an embroidery data storage area 152, a program storage area 153, and a setting value storage area 154. Image data for various types of images, such as images that may be used as the basis for the embroidery data creation, and the like, may be stored in the image data storage area 151. Embroidery data that are created by embroidery data creation processing in the present embodiment may be stored in the embroidery data storage area 152. Programs for various types of processing that may be performed by the embroidery data creation device 1, such as an embroidery data creation program that will be described later and the like, may be stored in the program storage area 153. Data on setting values that are to be used in the various types of processing may be stored in the setting value storage area 154.

The embroidery data creation program may be acquired from outside through the network 114 and stored in the program storage area 153. In a case where the embroidery data creation device 1 is provided with a DVD drive, the embroidery data creation program may be stored in a medium such as a DVD or the like and may be read and then stored in the program storage area 153.

Figure 2:
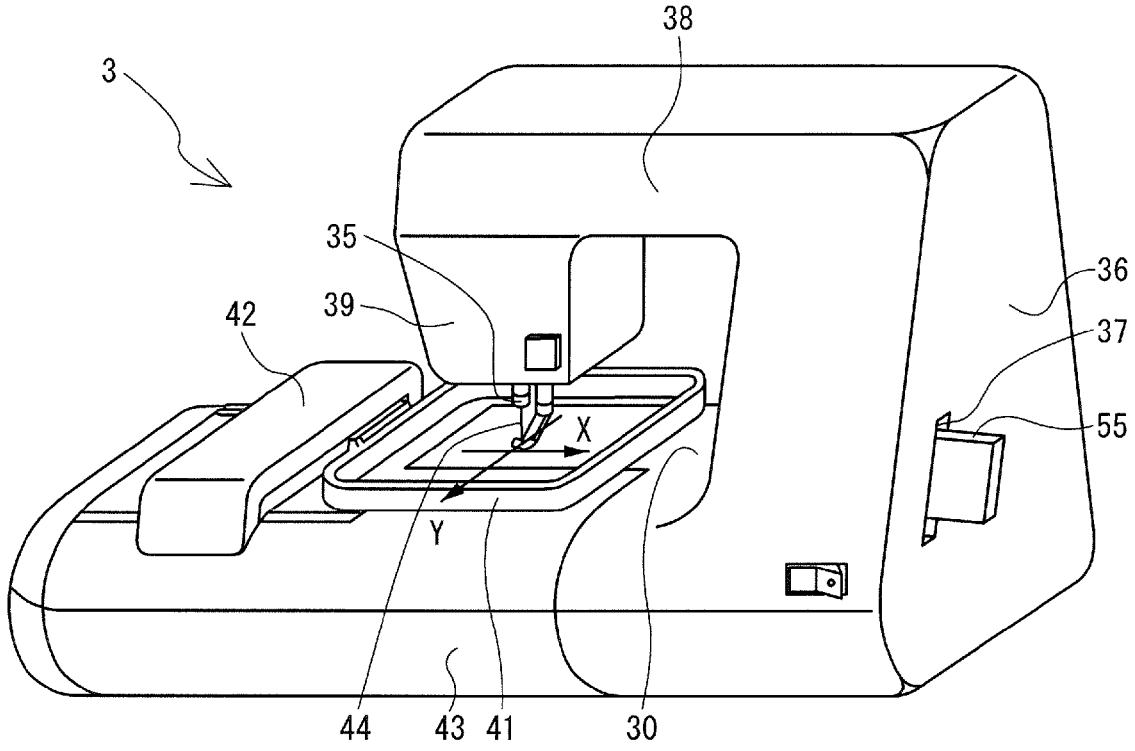
FIG. 2 is an exterior view of a sewing machine.

The sewing machine 3, which is configured to sew an embroidery pattern based on the embroidery data, will be briefly explained with reference to FIG. 2. As shown in FIG. 2, the sewing machine 3 includes a bed 30, a pillar 36, and arm 38, and a head 39. The bed 30 is the base of the sewing machine 3 and is long in the left-right direction. The pillar 36 extends upward from the right end portion of the bed 30. The arm 38 extends to the left from the upper end of the pillar 36 such that the arm 38 is positioned opposite the bed 30. The head 39 is a portion that is joined to the left end of the arm 38.

When embroidery sewing is performed, a user of the sewing machine 3 may mount an embroidery frame 41 that holds a work cloth onto a carriage 42 that is disposed on the bed 30. The embroidery frame 41 may be moved by a Y direction moving mechanism (not shown in the drawings) that is contained in the carriage 42 and by an X direction moving mechanism (not shown in the drawings) that is contained in a main case 43 to a needle drop point that is indicated by an XY coordinate system that is unique to the sewing machine 3. In conjunction with the moving of the embroidery frame 41, a shuttle mechanism (not shown in the drawings) and a needle bar 35 to which a sewing needle 44 is attached may be operated, thereby forming an embroidery pattern on the work cloth. Note that the Y direction moving mechanism, the X direction moving mechanism, the needle bar 35, and the like may be controlled based on the embroidery data by a CPU (not shown in the drawings) that is built into the sewing machine 3. In the present embodiment, the embroidery data are data that indicate the coordinates of the needle drop points, the sewing order, and the colors of the embroidery threads to be used in order to form the stitches of the embroidery pattern.

A memory card slot 37 in which the memory card 55 can be removably inserted is provided on the right side face of the pillar 36 of the sewing machine 3. The embroidery data that have been created by the embroidery data creation device 1, for example, may be stored in the memory card 55 through the memory card connector 23. Then the memory card 55 may be inserted in the memory card slot 37 of the sewing machine 3, and the embroidery data that are stored in the memory card 55 may be read out and stored in the sewing machine 3. Based on the embroidery data that have been read from the memory card 55, the CPU of the sewing machine 3 may control the operation of the sewing of the embroidery pattern by the Y direction moving mechanism, the X direction moving mechanism, the needle bar 35, and the like. The sewing machine 3 is thus able to sew the embroidery pattern based on the embroidery data that have been created by the embroidery data creation device 1.

The embroidery data creation processing that is performed by the embroidery data creation device 1 according to the present embodiment will be explained with reference to FIG. 3 to FIG. 6. When the user inputs an instruction to start the processing via the keyboard 21, the embroidery data creation processing shown in FIG. 3 is started by the CPU 11 executing instructions of the embroidery data creation program that is stored in the program storage area 153 of the HDD 15.

Figure 3:
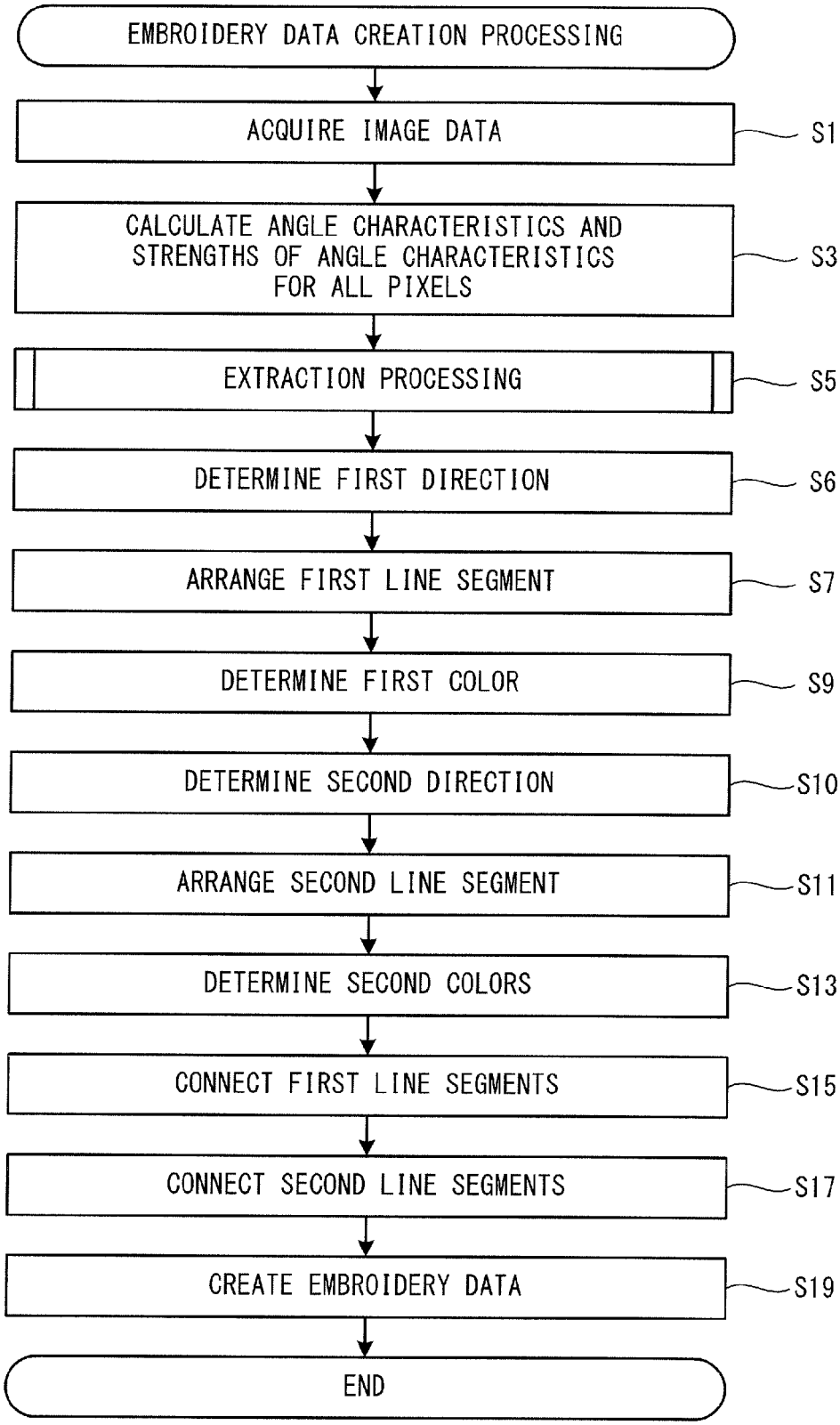
FIG. 3 is a flowchart of embroidery data creation processing.

As shown in FIG. 3, the CPU 11 acquires image data for an image (hereinafter referred to as an original image) that serves as the basis for creating the embroidery data, and stores the image data in the RAM 12 (step S1). The image data includes data for a physical quantity that indicates a color of each of a plurality of pixels that make up the original image. In the present embodiment, an RGB value is employed as the physical quantity. The RGB value indicates each element of red (R), green (G) and blue (B), using a value in a range from a minimum luminance value (0 in the present embodiment) to a maximum luminance value (255 in the present embodiment). Note that the image data may include data for another physical quantity, other than the RGB value, that indicates the color of each of the plurality of pixels. For example, the image data may include data for values that represent hue, saturation and brightness that indicate the color of each of the plurality of pixels. A method for acquiring the image data is not particularly limited. For example, in a case where a photograph or a design is read by the image scanner unit 25, the CPU 11 may acquire the image data from the image scanner unit 25. For example, the CPU 11 may acquire the image data that is stored in advance in the image data storage area 151 of the HDD 15, or the image data that is stored in an external storage medium, such as the memory card 55 or the like. The CPU 11 may acquire the image data from outside through the network 114.

Based on the acquired image data, the CPU 11 calculates an angle characteristic and a strength of the angle characteristic for each of all the pixels that make up the original image (step S3). The angle characteristic is information that indicates a direction in which the continuity of a color in the image is high. In other words, the angle characteristic is information that indicates the direction (angle) in which a color of a certain pixel is more continuous when the color of that certain pixel is compared with colors of surrounding pixels. The strength of the angle characteristic is information that indicates a magnitude of the continuity of the color. Any sort of method can be used to calculate the angle characteristic and the strength of the angle characteristic. For example, the angle characteristic and the strength of the angle characteristic can be calculated using the method that is described in detail in Japanese Laid-Open Patent Publication No. 2001-259268 (US Patent Application Publication No. 2002/0038162), relevant portions of which are incorporated herein by reference. To explain briefly, the CPU 11 may first set, as a target pixel, one of the pixels that make up the original image and sets, as a target area, the target pixel and a specified number (eight, for example) of pixels that surround the target pixel. Based on attribute values relating to the colors of the respective pixels in the target area, the CPU 11 may identify the direction in which the continuity of the color in the target area is high, and sets the direction as the angle characteristic of the target pixel. The attribute values relating to a color of a pixel may be, for example, luminance values of red, green and blue, represented together as an RGB value. For example, centered on the target pixel, the angle characteristic may be represented by an angle taking the rightward direction in the image as 0 degrees, the downward direction as 90 degrees and the leftward direction as 180 degrees. The CPU 11 may calculate information that indicates the magnitude of the continuity of the color in the target area, and may set the information as the strength of the angle characteristic of the target pixel. The CPU 11 may perform the processing for calculating the angle characteristics and the strengths of the angle characteristic sequentially for all the pixels that make up the original image. The CPU 11 may associate data that indicates the angle characteristic and the strength of the angle characteristic of each of the pixels with data that indicates the position of each of the pixels, and store the associated data in a specified storage area of the RAM 12.

The CPU 11 may perform similar processing by setting a plurality of pixels as target pixels, and may calculate the angle characteristic and the strength of the angle characteristic for each group that includes the plurality of pixels. In place of the above-described methods, the CPU 11 may calculate the angle characteristic and the strength of the angle characteristic using a Prewitt operator or a Sobel operator.

The CPU 11 performs processing (extraction processing, refer to FIG. 4) for extracting one or more particular pixels from the plurality of pixels that make up the original image, based on the image data (step S5). The particular pixel that is extracted by the extraction processing of the present embodiment has a luminance value that is different, by a specified value or more, from a luminance value of a pixel adjacent to the particular pixel. Hereinafter, the particular pixel extracted by the extraction processing is called a first pixel. Among the plurality of pixels that make up the original image, each of remaining one or more pixels other than the one or more first pixels is referred to as a second pixel.

The extraction processing will be explained with reference to FIG. 4. The CPU 11 performs Laplacian filter processing on the image data of the original image (step S21). In the present embodiment, an example is explained in which the half value of the sum of the maximum value and the minimum value of luminance values of red, green and blue of each of the plurality of pixels is processed through a Laplacian filter. Hereinafter, the half value of the sum of the maximum value and the minimum value of the luminance values of red, green and blue of a pixel is called a pixel luminance value. The value that is calculated by the Laplacian filter processing is called a calculated value. The calculated value indicates a difference between a pixel luminance value of a pixel and a pixel luminance value of another pixel adjacent to the pixel. The CPU 11 associates data that indicates the calculated values calculated by the Laplacian filter processing with data that indicates positions of the corresponding pixels, and stores the associated data in a specified storage area of the RAM 12.

Figure 5:
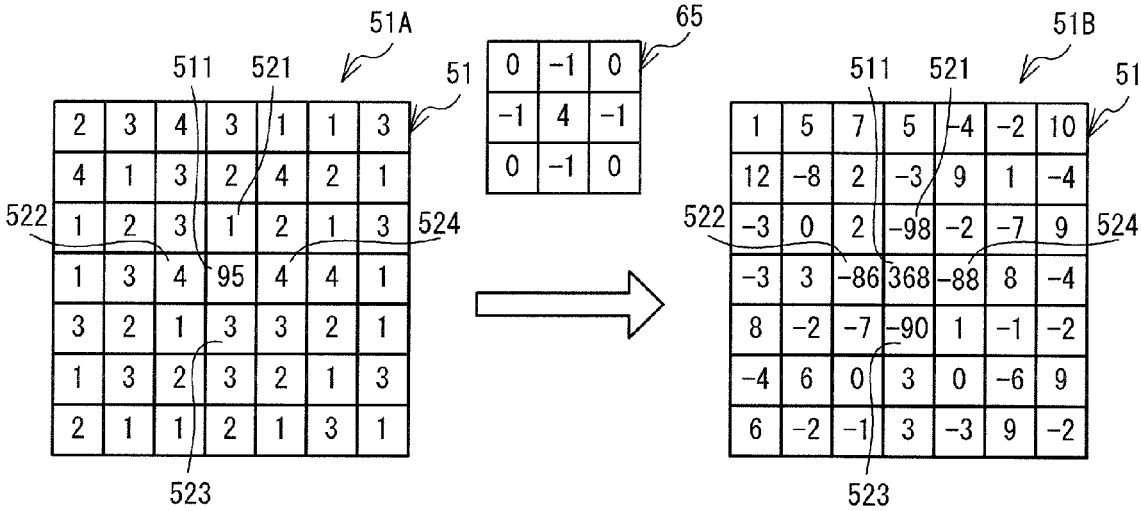
FIG. 5 is a diagram illustrating Laplacian filter processing.

The Laplacian filter processing is well-known processing that may be used for edge detection and image sharpening. Therefore, a detailed explanation of the Laplacian filter processing is omitted and an outline of the processing will be explained using specific examples. Here, processing by a four-neighbor Laplacian filter is used as an example. FIG. 5 shows a plurality of pixel luminance values 51A that respectively correspond to a plurality of pixels 51, a Laplacian filter 65, and a plurality of calculated values 51B obtained after the Laplacian filter processing. In the Laplacian filter processing, the CPU 11 disposes the Laplacian filter 65 such that the position of a target pixel of the plurality of pixels 51 matches the center of the Laplacian filter 65. The CPU 11 multiplies the pixel luminance values 51A by the corresponding elements of the Laplacian filter 65. The CPU 11 sets the sum of the obtained values as the calculated value of the target pixel after the processing. The CPU 11 performs the above-described processing for all the plurality of pixels 51.

Among the plurality of pixel luminance values 51A, the pixel luminance value "95" that corresponds to a center pixel 511 of the plurality of pixels 51 is significantly larger than the luminance values "1", "4", "3" and "4" of respective four neighboring pixels 521, 522, 523 and 524 of the center pixel 511. In this case, as shown by the plurality of calculated values 51B, the calculated value "368" that corresponds to the center pixel 511 is larger than calculated values that correspond to the four neighboring pixels of the center pixel 511. On the other hand, each of the calculated values "−98", "−86", "−90" and "−88" that respectively correspond to the four neighboring pixels 521, 522, 523 and 524 of the center pixel 511 is smaller than the calculated values that correspond to its four neighboring pixels. In the Laplacian filter processing, a degree of difference between the luminance value of the target pixel and the luminance values of the pixels surrounding the target pixel is calculated. In summary, a large absolute value of the calculated value implies that the difference of the luminance values is large with respect to the surrounding pixels.

Note that the elements of the Laplacian filter 65 shown in FIG. 5 are merely examples, and another Laplacian filter having other elements may be used. In the above explanation, an example is given in which the elements of the Laplacian filter 65 are associated in a one-to-one correspondence with the plurality of pixels 51. However, for example, the CPU 11 may associate one element of the Laplacian filter 65 with one of a plurality of groups, in which a specified number (four or nine, for example) of the pixels 51 are grouped, when performing the Laplacian filter processing. In this case, the CPU 11 may use the total value of the pixel luminance values that correspond to a plurality of pixels belonging to a group, as the pixel luminance value corresponding to the group.

The target for the Laplacian filter processing may be, for example, any one of the luminance values of red, green and blue, instead of the pixel luminance value. All of the luminance values of red, green and blue may be taken as the target for the Laplacian filter processing. In a case where the image data includes data for other physical quantities (hue, saturation and brightness, for example) indicating a color, other than the RGB values, the Laplacian filter processing can also be applied in the same manner as in the above-described example.

Figure 4:
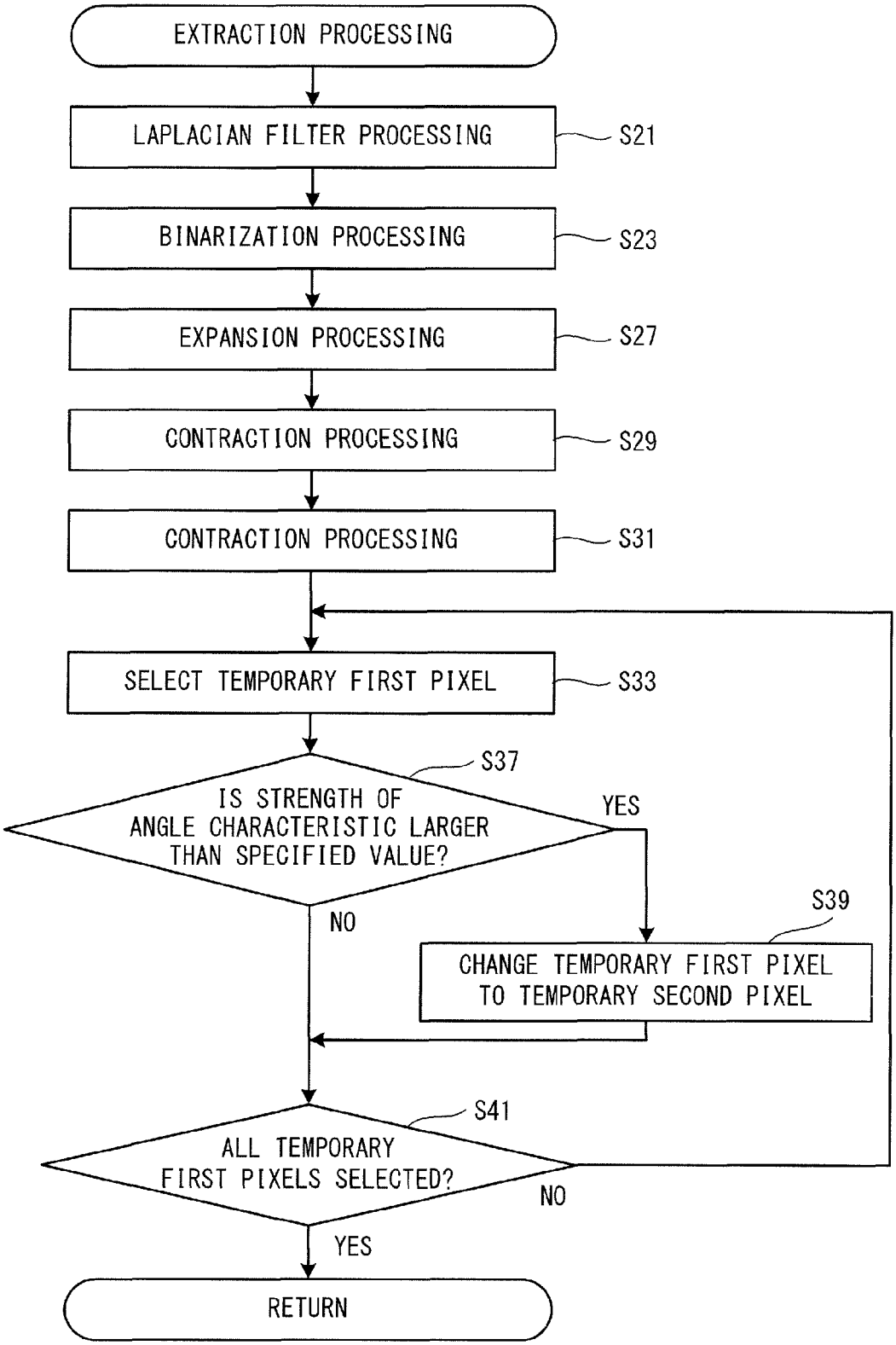
FIG. 4 is a flowchart of extraction processing.

As shown in FIG. 4, next, the CPU 11 performs binarization processing on the calculated values that have been calculated by the Laplacian filter processing (step S23). In the binarization processing, the plurality of pixels are classified into pixels each corresponding to a calculated value that is less than a specified threshold value and pixels each corresponding to a calculated value that is not less than the specified threshold value. Hereinafter, a pixel corresponding to a calculated value that is less than the specified threshold value is called a temporary first pixel, and a pixel corresponding to a calculated value that is not less than the specified threshold value is called a temporary second pixel. Next, the CPU 11 performs expansion processing (step S27). In the expansion processing, in a case where a temporary first pixel is in one of four neighboring locations of a temporary second pixel, the CPU 11 changes the temporary second pixel to a temporary first pixel. Next, the CPU 11 performs contraction processing twice consecutively (step S29, step S31). In the contraction processing, in a case where a temporary second pixel is in one of four neighboring locations of a temporary first pixel, the CPU 11 changes the temporary first pixel to a temporary second pixel. After the CPU 11 has performed the contraction processing for the second time, the CPU 11 associates, for each of the plurality of pixels, data indicating one of the temporary first pixel and the temporary second pixel with data indicating the position of the pixel, and stores the associated data in a specified storage area of the RAM 12.

Figure 6:
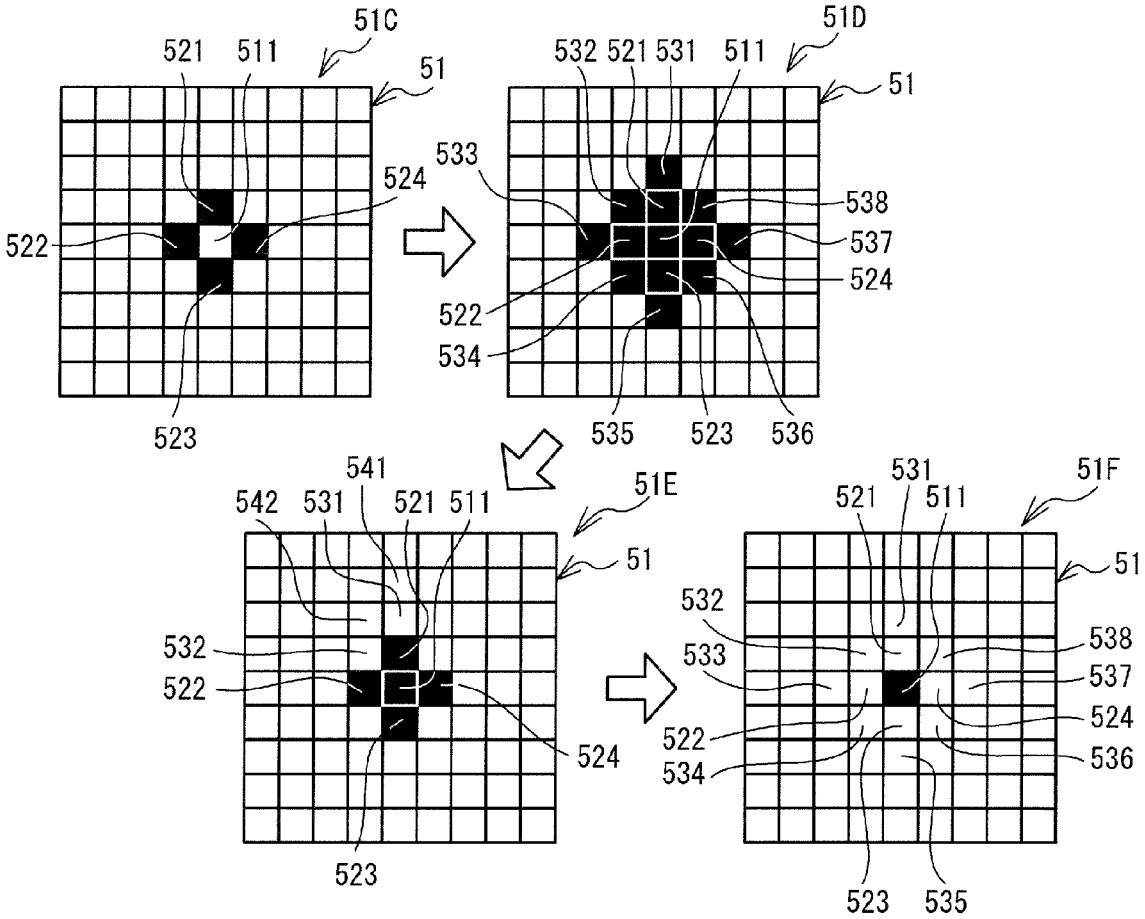
FIG. 6 is a diagram illustrating expansion processing and contraction processing.

The binarization processing (step S23, refer to FIG. 4), the expansion processing (step S27, refer to FIG. 4) and the contraction processing (step S29, step S31, refer to FIG. 4) will be explained with reference to FIG. 6, with a specific example using the calculated values 51B shown in FIG. 5. In FIG. 6, the temporary first pixels are shown in black and the temporary second pixels are shown in white. When the binarization processing in which the specified threshold value is set to "−10" is performed on the calculated values 51B, a processing result 51C shown in FIG. 6 is obtained. Specifically, each of the four neighboring pixels 521 (whose calculated value is −98), 522 (whose calculated value is −86), 523 (whose calculated value is −90) and 524 (whose calculated value is −88) of the center pixel 511 are each classified as a temporary first pixel. On the other hand, among the plurality of pixels 51, the pixels other than the pixels 521 to 524 are each classified as a temporary second pixel by the binarization processing.

Next, when the expansion processing is performed, a processing result 51D is obtained. For example, with regard to a pixel 531 that is classified as a temporary second pixel by the binarization processing, a temporary first pixel (specifically, the pixel 521) exists in one of the four neighboring locations of the pixel 531. Therefore, the pixel 531 is changed from the temporary second pixel to a temporary first pixel. Similar processing is performed on all the temporary second pixels. As a result, each of the pixels 511 and 531 to 538, each of which is a neighboring pixel of one of the pixels 521, 522, 523 and 524, is changed from a temporary second pixel to a temporary first pixel.

Next, when the contraction processing is performed for the first time, a processing result 51E is obtained. For example, with regard to the pixel 531, a temporary second pixel (specifically, a pixel 541) exists in one of the four neighboring locations of the pixel 531. Therefore, the pixel 531 is changed from the temporary first pixel to a temporary second pixel. In a similar manner, with regard to the pixel 532, a temporary second pixel (a pixel 542) exists in one of the four neighboring locations of the pixel 532. Therefore, the pixel 532 is changed from a temporary first pixel to a temporary second pixel. Similar processing is performed on all the temporary first pixels. As a result, as shown by the processing result 51E, among the plurality of pixels 51, the pixels 511 and 521 to 524 are classified as temporary first pixels and the other pixels are classified as temporary second pixels.

Next, when the contraction processing is performed for the second time, a processing result 51F is obtained. For example, with regard to the pixel 521, a temporary second pixel (the pixel 531) exists in one of the four neighboring locations of the pixel 521. Therefore, the pixel 521 is changed from the temporary first pixel to a temporary second pixel. With regard to the pixel 522, a temporary second pixel (the pixel 532) exists in one of the four neighboring locations of the pixel 522. Therefore, the pixel 522 is changed from the temporary first pixel to a temporary second pixel. Similar processing is performed on all the temporary first pixels. As a result, as shown by the processing result 51F, among the plurality of pixels 51, the pixel 511 is classified as a temporary first pixel and the pixels other than the pixel 511 are classified as temporary second pixels.

The specified threshold value that is used in the binarization processing may be stored in the HDD 15 in advance, or may be a value that is input via the keyboard 21*d*. Further, in the above explanation, an example is given in which the expansion processing is performed once and the contraction processing is performed twice. However, the number of times of execution of each of the expansion processing and the contraction processing is not limited to this example. For example, the CPU 11 may perform the expansion processing twice or more. The CPU 11 may perform the contraction processing once, or three times or more. The CPU 11 may perform the expansion processing and the contraction processing in any order. For example, the CPU 11 may perform the expansion processing once and the contraction processing twice, in the order of the contraction processing, the contraction processing and the expansion processing. The CPU 11 may perform the expansion processing once and the contraction processing twice, in the order of the contraction processing, the expansion processing and the contraction processing. The number of times of execution of each of the expansion processing and the contraction processing, and the order of execution may be stored in the HDD 15 in advance, or may be set in accordance with an instruction that is input via the keyboard 21.

In a case where the number of times of execution of the expansion processing is set to twice or more, it is possible to extract not one pixel but a plurality of adjacent pixels whose pixel luminance values are different from those of the other adjacent pixels by a specified value or more, as a group of temporary first pixels. In this case, as the number of times of execution of the expansion processing is increased, the number of the extracted temporary first pixels can be increased. For example, if the expansion processing is performed once, and the contraction processing is consecutively performed three times, and the expansion processing is further performed once, in that order, isolated one temporary first pixel is not finally extracted. That is, a plurality of adjacent pixels are always extracted as a group of temporary first pixels.

In the expansion processing, the CPU 11 may change a temporary second pixel to a temporary first pixel when a temporary first pixel is in one of eight neighboring locations (the upper side, the left side, the lower side, the right side, the upper left side, the lower left side, the upper right side and the lower right side), instead of the four neighboring locations (the upper side, the left side, the lower side and the right side), of the temporary second pixel. Further, also in the contraction processing, the CPU 11 may change a temporary second pixel to a temporary first pixel when a temporary second pixel is in one of the eight neighboring locations, instead of the four neighboring locations, of the temporary first pixel.

As shown in FIG. 4, next, the CPU 11 selects, from among all the temporary first pixels, one temporary first pixel that has not yet been selected (step S33). The CPU 11 reads the strength of the angle characteristic that corresponds to the selected temporary first pixel, from the specified storage area of the RAM 12. The CPU 11 determines whether or not the strength of the angle characteristic is larger than a specified value (step S37). In a case where the CPU 11 determines that the strength of the angle characteristic is larger than the specified value (yes at step S37), the CPU 11 advances the processing to step S39. The CPU 11 changes the temporary first pixel selected at step S33 to a temporary second pixel (step S39). The CPU 11 associates data indicating that the pixel is the temporary second pixel with data indicating the position of the corresponding pixel, and stores the associated data in the specified storage area of the RAM 12. The CPU 11 advances the processing to step S41. In a case where the CPU 11 determines that the strength of the angle characteristic is not larger than the specified value (no at step S37), the CPU 11 advances the processing to step S41.

The CPU 11 determines whether or not all the temporary first pixels have been selected (step S41). In a case where the CPU 11 determines that not all the temporary first pixels have been selected (no at step S41), the CPU 11 returns the processing to step S33. Then, the CPU 11 selects, from among all the temporary first pixels, one temporary first pixel that has not yet been selected (step S33), and repeats the above-described processing. In a case where the CPU 11 determines that all the temporary first pixels have been selected (yes at step S41), the CPU 11 ends the extraction processing and returns the processing to the embroidery data creation processing (refer to FIG. 3). A pixel stored in the RAM 12 as a temporary first pixel when the extraction processing is ended corresponds to a first pixel that has been finally extracted by the extraction processing, and a pixel stored in the RAM 12 as a temporary second pixel when the extraction processing is ended corresponds to a second pixel.

Note that the specified value that is used as the reference for the strength of the angle characteristic at step S37 may be stored in the HDD 15 in advance, or may be a value that is input via the keyboard 21. Further, the CPU 11 need not necessarily perform the processing at step S33, step S37, step S39 and step S41. In this case, regardless of the strength of the angle characteristic, a pixel that has been classified as a temporary first pixel when the processing at step S31 is ended may be set as a first pixel.

The CPU 11 may extract the one or more first pixels by processing other than the above-described extraction processing. For example, the following processing may be performed. When information that indicates a particular color is input via the keyboard 21, the CPU 11 identifies the particular color. From among a plurality of pixels, the CPU 11 classifies a pixel having a color for which a distance from the particular color in an RGB space is less than a threshold value as a temporary first pixel. The CPU 11 classifies a pixel having a color for which the distance from the particular color in the RGB space is not less than the threshold value as a temporary second pixel. Next, in a case where pixels that have been classified as the temporary first pixels include a plurality of adjacent temporary first pixels, the CPU 11 identifies the number of the plurality of adjacent temporary first pixels. In a case where the identified number is not less than a specified number, the CPU 11 changes each of the plurality of adjacent temporary first pixels from a temporary first pixel to a temporary second pixel. Next, the CPU 11 determines whether or not the strength of the angle characteristic that corresponds to the temporary first pixel is larger than a specified value. In a case where the strength of the angle characteristic is larger than the specified value, the CPU 11 changes the pixel from a temporary first pixel to a temporary second pixel. A pixel that is the temporary first pixel after the above-described processing is extracted as a first pixel. According to the above-described method, even when an impressive color portion that is specified by the user is tiny, the CPU 11 can create the embroidery data that can appropriately express the tiny portion by embroidery.

As shown in FIG. 3, after the extraction processing (step S5) is ended, the CPU 11 determines a direction of a line segment that is arranged in a position corresponding to the first pixel, among line segments that correspond to stitches of an embroidery pattern (step S6). Hereinafter, the line segment that is arranged in the position corresponding to the first pixel is called a first line segment. The direction in which the first line segment extends is called a first direction. The CPU 11 determines, as the first direction that corresponds to the first pixel, a direction that is orthogonal to a direction indicated by the angle characteristic that is associated with the first pixel, namely, a direction in which the angle characteristic indicates the color continuity is high. In a case where there are a plurality of the first pixels, the CPU 11 determines the first direction corresponding to each of the plurality of first pixels.

After the CPU 11 has determined the first direction corresponding to each of the one or more first pixels, the CPU 11 arranges the first line segment, which extends in the first direction, in a position corresponding to each of the one or more first pixels (step S7). The first line segment may have a specified length that is centered on the position that corresponds to the first pixel, for example. In a case where there are a plurality of the first pixels, the CPU 11 may select the plurality of first pixels one by one from the left to the right and from the top to the bottom, for example, and arrange the first line segment with respect to each of the first pixels. The CPU 11 stores data that indicates positions (coordinates) of end points of each of the one or more first line segments in a specified storage area of the RAM 12.

Note that the first direction is not limited to the direction that is orthogonal to the direction indicated by the angle characteristic. The first direction may obliquely intersect the direction indicated by the angle characteristic. The first direction may be parallel to the direction indicated by the angle characteristic. It is sufficient if the first line segment overlaps with the position that corresponds to the first pixel. In other words, the center of the first line segment need not necessarily be at the position that corresponds to the first pixel. In order to improve the finish of the embroidery pattern, it may be preferable that a portion other than the vicinity of the end points of the first line segment overlaps with the position that corresponds to the first pixel. The length of the first line segment may be stored in the HDD 15 in advance, or a value that is input via the keyboard 21 may be used. The length of the first line segment may be adjusted such that neither of the end points of the first line segment overlaps with an end point of another first line segment.

After the CPU 11 completes the arrangement of the one or more first line segments with respect to all the one or more first pixels, the CPU 11 determines a color corresponding to each of the one or more first line segments (step S9). Hereinafter, the color corresponding to the first line segment is called a first color. The first color may be determined as follows, for example. The CPU 11 identifies a color of each of the one or more first pixels based on the image data (RGB values). Based on the identified color of the first pixel, the CPU 11 determines, as the first color, a color of a thread (a thread color) to be used to sew a stitch that corresponds to the first line segment. For example, the CPU 11 may determine, as the first color, a color that is closest to the identified color of the first pixel, among a plurality of thread colors that are usable for embroidery sewing. The respective RGB values of the usable thread colors may be stored in advance in the HDD 15, for example. The CPU 11 calculates a spatial distance in the RGB space between the RGB value of each of the usable thread colors and the RGB value of the first pixel. The CPU 11 may determine, as the first color, the thread color for which the calculated distance is the smallest among the usable thread colors. The CPU 11 associates data that indicates the determined first color with data that indicates the corresponding first line segment, and stores the associated data in a specified storage area of the RAM 12.

The CPU 11 determines a direction of a line segment that is arranged in a position corresponding to the second pixel (step S10). Hereinafter, the line segment that is arranged in the position corresponding to the second pixel is called a second line segment. The direction in which the second line segment extends is called a second direction. The CPU 11 determines, as the second direction that corresponds to the second pixel, a direction indicated by the angle characteristic that is associated with the second pixel, namely, a direction in which the angle characteristic indicates the color continuity is high. In a case where there are a plurality of the second pixels, the CPU 11 determines the second direction corresponding to each of the plurality of second pixels.

After the CPU 11 has determined the second direction corresponding to each of the one or more second pixels, the CPU 11 performs processing for arranging the one or more second line segments (step S11). A method for arranging the one or more second line segments may be as follows, for example. First, the CPU 11 arranges the second line segment, which extends in the second direction, in a position corresponding to each of the one or more second pixels. Any known method may be used as the method for arranging the second line segment in the position corresponding to the second pixel. For example, it is possible to adopt the method that is described in detail in Japanese Laid-Open Patent Publication No. 2001-259268 (US Patent Application Publication No. 2002/0038162), relevant portions of which are incorporated herein by reference. According to this method, the CPU 11 arranges the second line segments so as not to overlap as much as possible, and so as to fill the whole image as much as possible. Each of the second line segments may extend in the second direction determined at step S10, and have a specified length centered on the second pixel, for example. In a case where there are a plurality of the second pixels, the CPU 11 may select the plurality of second pixels one by one from the left to the right and from the top to the bottom, for example, and arrange the second line segment with respect to each of the second pixels. The CPU 11 stores data that indicates positions (coordinates) of end points of each of the second line segments in a specified storage area of the RAM 12.

In the present embodiment, all the pixels other than the one or more first pixels are the second pixels. If the second line segments are respectively arranged corresponding to all the second pixels, many overlapped stitches would be formed, although the whole image can be filled with stitches. To address this, in the method disclosed in Japanese Laid-Open Patent Publication No. 2001-259268 (US Patent Application Publication No. 2002/0038162), after a line segment corresponding to a pixel for which the strength of the angle characteristic is high is arranged by priority, a line segment that is less likely to overlap with the already arranged line segment is arranged by priority. In the present embodiment, an additional condition is given priority over the above-described two arrangement conditions. The additional condition is that a second line segment that passes through a portion that corresponds to the first pixel is not arranged. Specifically, the CPU 11 performs processing in the following manner.

The CPU 11 reads the data that indicates the positions of pixels from the RAM 12. Based on the read data, the CPU 11 determines whether or not a part of a second line segment overlaps with a portion that corresponds to a first pixel when the second line segment is arranged in a position that corresponds to the current target second pixel. In a case where the CPU 11 determines that a part of the second line segment overlaps with the portion that corresponds to the first pixel, the CPU 11 does not arrange the second line segment that corresponds to the target second pixel. In a case where the CPU 11 determines that no part of the second line segment overlaps with the portion that corresponds to the first pixel, the CPU 11 determines whether or not a line segment is to be arranged for the target second pixel, in accordance with the above-described known two arrangement conditions. The above processing is performed sequentially for all the second pixels. Thus, the CPU 11 can inhibit a part of the second line segment from overlapping with the portion of the first line segment that corresponds to the first pixel. The CPU 11 stores data that indicates positions (coordinates) of the end points of each of the second line segments that have been finally arranged, in the specified storage area of the RAM 12.

In a case where the CPU 11 determines that a part of the second line segment overlaps with the portion that corresponds to the first pixel, the CPU 11 may inhibit a part of the second line segment from overlapping with the portion that corresponds to the first pixel, using the following method, for example. The CPU 11 may shorten the length of the second line segment. The CPU 11 may move the second line segment in the second direction while maintaining a state in which the second line segment overlaps with a position that corresponds to the second pixel.

After the CPU 11 completes the arrangement of the one or more second line segments, the CPU 11 determines a color corresponding to each of the one or more second line segments (step S13). Hereinafter, the color corresponding to the second line segment is called a second color. As a method for determining the second color, it is possible to adopt, for example, a method that is similar to but partly modified from the method that is described in detail in Japanese Laid-Open Patent Publication No. 2001-259268 (US Patent Application Publication No. 2002/0038162), relevant portions of which are incorporated herein by reference. To explain briefly, in the original image, the CPU 11 sets a specified range centered on the second pixel that corresponds to the target second line segment, as a range in which a color of the original image is referred to. Hereinafter, the range in which the color of the original image is referred to is called a specified area. First, the CPU 11 prepares, in the RAM 12, image data for a working image that is used to determine a color of the second line segment. Hereinafter, the working image is called a color determination image. The color determination image has the same size as the original image, and, in an initial state, no color is set in the color determination image. Next, in the color determination image, the CPU 11 sets, for a pixel that corresponds to the first pixel, the first color corresponding to the first pixel (corresponding to the first line segment). Based on the image data of the original image, the CPU 11 calculates a sum Cx of respective RGB values of all the pixels included in the specified area of the original image. Further, the CPU 11 identifies a number Nx of the pixels included in the specified area. Next, the CPU 11 calculates a sum Cy of respective RGB values of one or more pixels which are included in an area, of the color determination image, that corresponds to the specified area, and whose colors have already been set. Hereinafter, the area of the color determination image that corresponds to the specified area is called a corresponding area. Note that the pixels whose colors have already been set may include the first pixel corresponding to the first line segment (i.e. the first pixel corresponding to the center of the first line segment) for which the first color has been determined, and pixels through which passes the second line segment for which the second color (which will be described later) has already been determined. Further, the CPU 11 identifies a number Ny of the pixels which are within the corresponding area and whose colors have already been determined. However, in the calculation of the sum Cy and the identification of the number Ny, the CPU 11 does not include the pixels through which passes the second line segment that is a calculation target for the second color, within the corresponding area. The CPU 11 identifies a number Na of the pixels through which passes the second line segment that is the calculation target for the second color, within the corresponding area. The variables defined above are summarized as follows.

Cx: the sum of the RGB values of the pixels within the specified area of the original image Nx: the number of pixels within the specified area of the original image Cy: the sum of the RGB values of the one or more pixels which are within the corresponding area of the color determination image and whose colors have already been determined Ny: the number of the pixels used to calculate the sum Cy Na: the number of the pixels through which passes the second line segment that is a calculation target for the second color, within the corresponding area The CPU 11 calculates an RGB value La that satisfies the following formula.

$$Cx/Nx=(Cy+La\times Na)/(Ny+Na)$$

Next, the CPU 11 determines, as the second color, a color whose RGB value is closest to the calculated RGB value La among the plurality of usable thread colors. The second color is a color of a thread (a thread color) to be used to sew a stitch that corresponds to the second line segment. In the color determination image, the CPU 11 sets the second color for the pixels through which passes the second line segment for which the second color has just been determined, as the pixels for which the color has already been set. In a case where there are a plurality of the second line segments, the above processing is performed sequentially for all the second line segments. According to this processing, based on the color of the original image and on the first color(s) and the second color(s) that have already been determined, a new second color is determined. The CPU 11 associates data that indicates the determined second color with data that indicates the corresponding second line segment, and stores the associated data in a specified storage area of the RAM 12.

The CPU 11 performs processing for connecting the first line segments (step S15). Any known method may be used as a method for connecting the first line segments. For example, it is possible to adopt the method that is described in detail in Japanese Laid-Open Patent Publication No. 2001-259268 (US Patent Application Publication No. 2002/0038162), relevant portions of which are incorporated herein by reference. According to this method, in a case where there is only one first color, firstly, the CPU 11 sets the first line segment that is closest to a position that corresponds to the left end of the original image, as a line segment that is first in an order of connection. The CPU 11 sets one of two end points of this first line segment as a starting point and sets the other end point as an ending point. Next, among the other first line segments, the CPU 11 determines a line segment having an end point that is located closest to the ending point of the first line segment that is first in the order of connection, as a connection destination, namely, as a line segment that is second in the order of connection. In a similar manner, the CPU 11 sequentially connects, to the ending point of the first line segment that has already been connected, an end point of another first line segment that is located closest to the ending point. In a case where there are a plurality of the first colors, the CPU 11 performs the above processing for each group of first line segments for which the same first color has been determined.

After that, the CPU 11 connects the first line segment groups that have been connected for each of the first colors, and thus connects all the first line segments. The CPU 11 creates data that indicates positions (coordinates) of the end points of all the connected first line segments, the order of connection and thread color(s). Hereinafter, the data created at step S15 is called first line segment data. The CPU 11 stores the first line segment data in a specified storage area of the RAM 12.

Next, the CPU 11 performs processing that connects the second line segments for each of the one or more second colors determined at step S13 (step S17). A method for connecting the second line segments may be the same as the method for sequentially connecting the first line segments. Therefore, an explanation of the method for connecting the second line segments is omitted here. The CPU 11 creates data that indicates positions (coordinates) of the end points of all the connected second line segments, the order of connection and thread colors. Hereinafter, the data created at step S17 is called second line segment data. The CPU 11 stores the second line segment data in a specified storage area of the RAM 12.

Based on the first line segment data and the second line segment data, the CPU 11 performs processing for creating the embroidery data (step S19). A method for creating the embroidery data may be as follows, for example. The CPU 11 reads the first line segment data from the RAM 12. The CPU 11 converts the coordinates of the end points of the one or more first line segments identified by the first line segment data into coordinates of an embroidery coordinate system that is unique to the sewing machine 3. The CPU 11 sets the converted coordinates as coordinates of needle drop points. The CPU 11 sets, as a sewing order, the order of connection that is identified by the first line segment data. The CPU 11 creates the embroidery data for one or more stitches that correspond to the one or more first line segments, from data indicating the needle drop points, data indicating the sewing order, and data indicating thread color(s) included in the first line segment data. Hereinafter, a stitch that corresponds to a first line segment is called a first stitch and the embroidery data of the one or more stitches that corresponds to the one or more first line segments is called first stitch data. Next, the CPU 11 reads the second line segment data from the RAM 12. The CPU 11 converts the coordinates of the end points of the one or more second line segments identified by the second line segment data into coordinates of the embroidery coordinate system that is unique to the sewing machine 3. In the same manner as in the case of the one or more first line segments, the CPU 11 creates the embroidery data of one or more stitches that correspond to the one or more second line segments. Hereinafter, a stitch that corresponds to a second line segment is called a second stitch and the embroidery data of the one or more stitches that corresponds to the one or more second line segments is called second stitch data. The CPU 11 connects the first stitch data and the second stitch data, thus creating final embroidery data. At this time, the CPU 11 sets the sewing order indicated by the second stitch data after the sewing order indicated by the first stitch data. Thus, the CPU 11 creates the embroidery data that makes it possible to sew the one or more first stitches before the one or more second stitches. The CPU 11 stores the created embroidery data in the embroidery data storage area 152 of the HDD 15. The CPU 11 ends the embroidery data creation processing.

Figure 7:
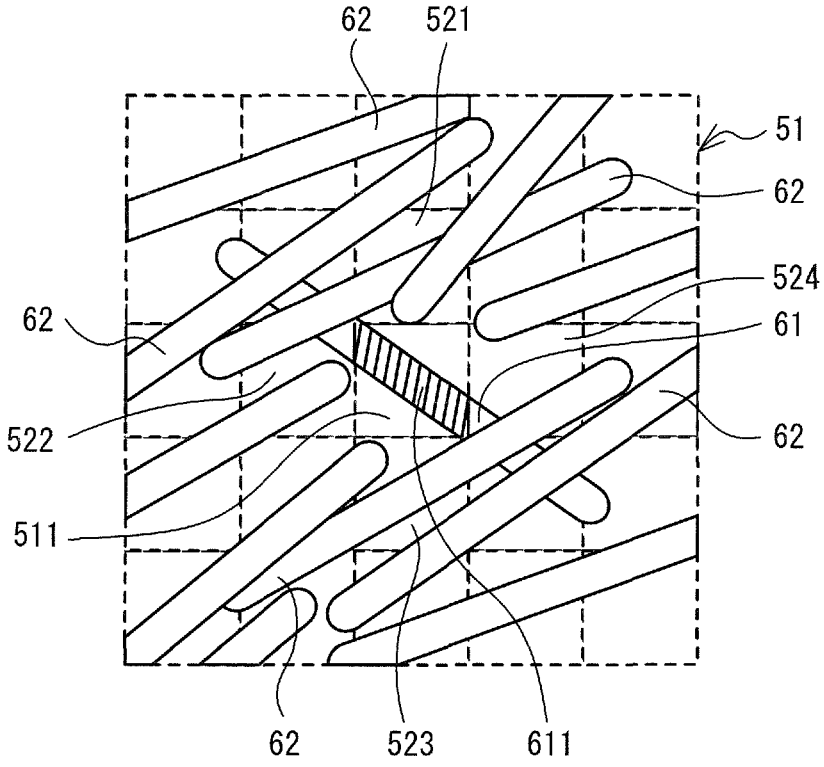
FIG. 7 is a diagram showing an example of an embroidery pattern.

An example of an embroidery pattern when the sewing machine 3 performs sewing based on the created embroidery data will be explained with reference to FIG. 7. An example is used in which the pixel 511 shown in FIG. 5 and FIG. 6 is extracted as the first pixel by the extraction processing (step S5, refer to FIG. 3) and, of the plurality of pixels 51, the pixels other than the pixel 511 are set as the second pixels. Note that, in FIG. 7, in order to facilitate understanding, a first stitch 61 and a plurality of second stitches 62 of the embroidery pattern sewn on a cloth are shown in a state in which the stitches overlap with the plurality of pixels 51 included in the original image. Further, in actuality, end points of the plurality of second stitches 62 are connected to each other (the ending point of a stitch and the starting point of the next stitch are the same). However, in FIG. 7, in order to avoid the drawing becoming complicated, the plurality of second stitches 62 are shown separately.

As described above, in the present embodiment, the CPU 11 arranges the second line segment such that a part of the second line segment does not overlap with a portion of the first line segment that corresponds to the first pixel 511 (step S11, refer to FIG. 3). Therefore, when the sewing machine 3 performs embroidery sewing based on the created embroidery data, a portion 611 (a hatched portion in FIG. 7), which corresponds to the first pixel 511, of the first stitch 61 that is sewn on the cloth always appears on the front side of the cloth. Further, the CPU 11 creates the embroidery data by adjusting the sewing order such that the sewing order of the second stitches 62 is after the sewing order of the first stitch 61 (step S19, refer to FIG. 3). Therefore, when the sewing machine 3 performs embroidery sewing based on the created embroidery data, the second stitches 62 overlap, from the front side of the cloth, with portions of the first stitch 61 sewn on the cloth that are other than the portion 611 that corresponds to the first pixel 511. In this case, the size of portions of the first stitch 61 that appear on the front side of the cloth may be smaller than the whole size of the first stitch 61.

Normally, directions indicated by angle characteristics of a plurality of pixels that are located close to each other are likely to be similar to each other. Therefore, positions of needle drop points of stitches that respectively correspond to the plurality of pixels that are located close to each other are likely to be close to each other. In contrast to this, in the present embodiment, the CPU 11 determines the direction that is orthogonal to the direction indicated by the angle characteristic of the first pixel (the pixel 511 in the example shown in FIG. 7), as the direction (the first direction) in which the first line segment extends (step S6, refer to FIG. 3). On the other hand, the CPU 11 determines the direction indicated by the angle characteristic of each of the second pixels (for example, the pixels 521 to 524, which are pixels of the plurality of pixels 51 and which are other than the pixel 511), as the direction (the second direction) in which the second line segment extends (step S10, refer to FIG. 3). In this case, the positions of the respective end points of the first line segment and the second line segment that are located close to each other, namely, the respective positions of the needle drop points of the first stitch 61 and the second stitches 62, are more likely to be separated from each other.

As explained above, when the difference between the pixel luminance value of a particular pixel of the plurality of pixels and the pixel luminance value of a pixel that is adjacent to the particular pixel is not less than a specified value, the CPU 11 extracts the particular pixel as the first pixel (step S5). With regard to the extracted first pixel, the difference is noticeable in comparison to the second pixels which are, of the plurality of pixels, pixels other than the first pixel. Therefore, if the color corresponding to the first pixel is appropriately expressed in an embroidery pattern, the embroidery pattern may have a good appearance. Therefore, the CPU 11 arranges the second line segment that corresponds to the second pixel such that a part of the second line segment does not overlap with a portion of the first line segment that corresponds to the first pixel (step S11). Thus, the CPU 11 can create the embroidery data that makes it possible to perform sewing such that the second stitch does not overlap with a portion of the first stitch that corresponds to the first pixel. When the sewing machine 3 performs embroidery sewing based on the created embroidery data, the portion of the first stitch that corresponds to the first pixel appears on the front side of the cloth. Therefore, the portion corresponding to the first pixel can be appropriately expressed by the first stitch of the first color that is determined based on the color of the first pixel. In this manner, the CPU 11 can create the embroidery data that makes it possible to appropriately express the portion corresponding to the first pixel by embroidery.

The CPU 11 creates the embroidery data by adjusting the sewing order such that the sewing order of the one or more second stitches is after the sewing order of the one or more first stitches (step S19). When the sewing machine 3 performs embroidery sewing based on the created embroidery data, the one or more first stitches are sewn before the one or more second stitches. Therefore, the second stitch may overlap, from the front side of the cloth, with a portion of the first stitch other than the portion that corresponds to the first pixel. In this case, the size of portions of the first stitch that appear on the front side of the cloth is smaller than the whole size of the first stitch. Therefore, by using the first stitch to expresses a tiny portion of the original image, the sewing machine 3 can express the tiny portion by embroidery. In this manner, the CPU 11 can create the embroidery data that can appropriately express the tiny portion by embroidery.

In a case where the strength of the angle characteristic is smaller than the specified value, the CPU 11 extracts a corresponding pixel as the first pixel (step S37). The pixel corresponding to the strength of the angle characteristic that is smaller than the specified value shows low color continuity, and therefore corresponds to the tiny portion in the original image. Therefore, by appropriately extracting the tiny portion of the original image and expressing the tiny portion using the first stitch, the CPU 11 can create the embroidery data that can express the tiny portion by embroidery.

The CPU 11 determines, as the first direction, the direction that is orthogonal to the direction indicated by the angle characteristic (step S6), and determines, as the second direction, the direction indicated by the angle characteristic (step S10). As a result, the respective needle drop points of the first stitch and the second stitch are less likely to overlap with or come close to each other. When the respective needle drop points of the first stitch and the second stitch overlap with or come close to each other, holes that are formed at the needle drop points in the cloth are densely arranged and thus the cloth is more likely to be damaged. For that reason, it is preferable that the respective needle drop points of the first stitch and the second stitch are arranged to be separated from each other. Therefore, by reducing the possibility that the respective needle drop points of the first stitch and the second stitch overlap with or come close to each other, the CPU 11 can create the embroidery data that can suppress the cloth from being damaged by the sewing.

The CPU 11 determines the first color based only on the color of the first pixel (step S9). Thus, the CPU 11 can determine, as the first color, the color by which the color of the first pixel of the original image can be expressed more appropriately. On the other hand, the CPU 11 determines the second color based on the colors in the specified area of the original image, the color that has already been determined for another second line segment arranged in the specified area and the color of the first line segment arranged in the specified area (step S13). By determining a new second color based on the first color and the second color in the specified area, the CPU 11 can determine the second color that is appropriate as a color corresponding to the specified area.

Various modifications may be made to the above-described embodiment. In the above-described embodiment, the method is exemplified in which the first direction and the second direction are determined based on a direction in which the angle characteristic indicates the color continuity is high. However, the first direction and the second direction may be determined using another method. For example, the CPU 11 may determine a specified direction (the left-right direction, for example) as the second direction and may determine a direction (the up-down direction, for example) that intersects the second direction, as the first direction. Further, for example, the CPU 11 may arrange the one or more second line segments by adopting the method that is described in detail in Japanese Laid-Open Patent Publication No. 2000-288275 (U.S. Pat. No. 6,324,441), relevant portions of which are incorporated herein by reference. When this method is used to arrange the one or more second line segments, if the second line segment overlaps with a position corresponding to the first pixel, the CPU 11 may move the second line segment such that the second line segment does not overlap with the position corresponding to the first pixel. The direction in which the second line segment is moved may be the direction in which the second line segment extends.

In the extraction processing (refer to FIG. 4), after the processing at step S41, in a case where a plurality of the temporary first pixels are adjacent to each other, the CPU 11 may determine whether or not the number of the adjacent temporary first pixels is larger than a specified number. In a case where the number of the adjacent temporary first pixels is larger than the specified number, the CPU 11 may change the adjacent temporary first pixels to temporary second pixels.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A device, comprising:

a processor; and a memory configured to store computer-readable instructions that, when executed by the processor, cause the device to perform processes comprising:

acquiring image data, the image data including data for a physical quantity indicating respective colors of a plurality of pixels;

extracting, based on the image data, one or more first pixels from among the plurality of pixels, each of the one or more first pixels being a pixel for which a physical quantity indicating a color of the pixel is different, by at least a specified amount, from a physical quantity indicating a color of an adjacent pixel;

arranging one or more first line segments in one or more first positions respectively corresponding to the one or more first pixels;

determining one or more first colors respectively corresponding to the one or more first line segments, based on one or more respective colors of the one or more first pixels;

connecting the one or more first line segments for each of the one or more first colors;

arranging one or more second line segments in one or more second positions respectively corresponding to one or more second pixels such that none of the one or more second line segments overlaps with any one of the one or more first positions, the one or more second pixels being one or more pixels, among the plurality of pixels, other than the one or more first pixels;

determining one or more second colors respectively corresponding to the one or more second line segments, based at least on one or more respective colors of the one or more second pixels;

connecting the one or more second line segments for each of the one or more second colors; and creating embroidery data based on the one or more first line segments connected for each of the one or more first colors and on the one or more second line segments connected for each of the one or more second colors, the embroidery data indicating one or more first stitches and one or more second stitches and indicating that the one or more first stitches are sewn before the one or more second stitches, the one or more first stitches respectively corresponding to the one or more first line segments, and the one or more second stitches respectively corresponding to the one or more second line segments.

2. The device according to claim 1, wherein the computer-readable instructions cause the device to perform the processes further comprising:

calculating, based on the image data, a value indicating a magnitude of color continuity for each of the plurality of pixels, and wherein the extracting the one or more first pixels includes extracting, as a first pixel, a pixel for which the value is smaller than a specified value.

3. The device according to claim 2, wherein the computer-readable instructions cause the device to perform the processes further comprising:

calculating an angle characteristic for each of the plurality of pixels based on the image data, the angle characteristic being information indicating a direction in which the color continuity is high, wherein the arranging the one or more first line segments includes arranging each of the one or more first line segments along a first direction, the first direction being a direction intersecting the direction indicated by the angle characteristic of the first pixel corresponding to the first line segment, and wherein the arranging the one or more second line segments includes arranging each of the one or more second line segments along a second direction, the second direction being the direction indicated by the angle characteristic of the second pixel corresponding to the second line segment.

4. The device according to claim 1, wherein the arranging the one or more second line segments includes arranging the one or more second line segments such that positions of a starting point and an ending point of each of the one or more second line segments do not overlap with any one of positions of a starting point and an ending point of each of the one or more first line segments.

5. The device according to claim 1, wherein the determining the one or more first colors includes determining each of the one or more first colors based only on a color of the corresponding first pixel, and wherein the determining the one or more second colors includes determining each of the one or more second colors based on a first reference color, a second reference color and a third reference color, the first reference color being a color of a specified area, the specified area being an area within an image indicated by the image data and including at least one of the one or more second pixels, the second reference color being a color of a portion corresponding to a first pixel of a first line segment, among the one or more first line segments, arranged in an area corresponding to the specified area, and the third reference color being a color of a second line segment, among the one or more second line segments, arranged in the area corresponding to the specified area.

6. A non-transitory computer-readable medium storing computer-readable instructions that, when executed by a processor of a device, cause the device to perform processes comprising:

acquiring image data, the image data including data for a physical quantity indicating respective colors of a plurality of pixels;

extracting, based on the image data, one or more first pixels from among the plurality of pixels, each of the one or more first pixels being a pixel for which a physical quantity indicating a color of the pixel is different, by at least a specified amount, from a physical quantity indicating a color of an adjacent pixel;

arranging one or more first line segments in one or more first positions respectively corresponding to the one or more first pixels;

determining one or more first colors respectively corresponding to the one or more first line segments, based on one or more respective colors of the one or more first pixels;

connecting the one or more first line segments for each of the one or more first colors;

arranging one or more second line segments in one or more second positions respectively corresponding to one or more second pixels such that none of the one or more second line segments overlaps with any one of the one or more first positions, the one or more second pixels being one or more pixels, among the plurality of pixels, other than the one or more first pixels;

determining one or more second colors respectively corresponding to the one or more second line segments, based at least on one or more respective colors of the one or more second pixels;

connecting the one or more second line segments for each of the one or more second colors; and creating embroidery data based on the one or more first line segments connected for each of the one or more first colors and on the one or more second line segments connected for each of the one or more second colors, the embroidery data indicating one or more first stitches and one or more second stitches and indicating that the one or more first stitches are sewn before the one or more second stitches, the one or more first stitches respectively corresponding to the one or more first line segments, and the one or more second stitches respectively corresponding to the one or more second line segments.

7. The non-transitory computer-readable medium according to claim 6, wherein the computer-readable instructions cause the device to perform the processes further comprising:

calculating, based on the image data, a value indicating a magnitude of color continuity for each of the plurality of pixels, and wherein the extracting the one or more first pixels includes extracting, as a first pixel, a pixel for which the value is smaller than a specified value.

8. The non-transitory computer-readable medium according to claim 7, wherein the computer-readable instructions cause the device to perform the processes further comprising:

calculating an angle characteristic for each of the plurality of pixels based on the image data, the angle characteristic being information indicating a direction in which the color continuity is high, wherein the arranging the one or more first line segments includes arranging each of the one or more first line segments along a first direction, the first direction being a direction intersecting the direction indicated by the angle characteristic of the first pixel corresponding to the first line segment, and wherein the arranging the one or more second line segments includes arranging each of the one or more second line segments along a second direction, the second direction being the direction indicated by the angle characteristic of the second pixel corresponding to the second line segment.

9. The non-transitory computer-readable medium according to claim 6, wherein the arranging the one or more second line segments includes arranging the one or more second line segments such that positions of a starting point and an ending point of each of the one or more second line segments do not overlap with any one of positions of a starting point and an ending point of each of the one or more first line segments.

10. The non-transitory computer-readable medium according to claim 6, wherein the determining the one or more first colors includes determining each of the one or more first colors based only on a color of the corresponding first pixel, and wherein the determining the one or more second colors includes determining each of the one or more second colors based on a first reference color, a second reference color and a third reference color, the first reference color being a color of a specified area, the specified area being an area within an image indicated by the image data and including at least one of the one or more second pixels, the second reference color being a color of a portion corresponding to a first pixel of a first line segment, among the one or more first line segments, arranged in an area corresponding to the specified area, and the third reference color being a color of a second line segment, among the one or more second line segments, arranged in the area corresponding to the specified area.

* * * * *